US012799634B2

(12) United States Patent
Cascio

(10) Patent No.: US 12,799,634 B2
(45) Date of Patent: Nov. 17, 2026

(54) MELT-SPUN FILAMENTS, YARNS, AND METHODS OF MAKING THE SAME

(71) Applicant: ALADDIN MANUFACTURING CORPORATION, Calhoun, GA (US)

(72) Inventor: Anthony Cascio, Calhoun, GA (US)

(73) Assignee: Aladdin Manufacturing Corporation, Calhoun, GA (US)

( * ) Notice: Subject to any disclaimer, the term of this patent is extended or adjusted under 35 U.S.C. 154(b) by 328 days.

(21) Appl. No.: 18/035,644

(22) PCT Filed: Nov. 18, 2021

(86) PCT No.: PCT/US2021/059812

§ 371 (c)(1),
(2) Date: May 5, 2023

(87) PCT Pub. No.: WO2022/109083

PCT Pub. Date: May 27, 2022

(65) Prior Publication Data

US 2023/0407527 A1 Dec. 21, 2023

Related U.S. Application Data

(60) Provisional application No. 63/116,339, filed on Nov. 20, 2020.

(51) Int. Cl.

| | |
|---|---|
| ***D01D 5/253*** | (2006.01) |
| ***D01D 5/08*** | (2006.01) |
| ***D01D 5/24*** | (2006.01) |

(52) U.S. Cl.

CPC ..... *D01D 5/253* (2013.01); *D01D 5/08* (2013.01); *D01D 5/24* (2013.01); *D10B 2321/02* (2013.01);

(Continued)

(58) Field of Classification Search

CPC . D01D 4/00; D01D 5/24; D01D 5/253; Y10T 428/2973; Y10T 428/2975; Y10T 428/2976; Y10T 428/2978

See application file for complete search history.

(56) References Cited

U.S. PATENT DOCUMENTS 3,340,571 A 9/1967 Bishop et al.
3,984,515 A * 10/1976 Mommaerts ..... D01F 6/54 521/142

(Continued)

FOREIGN PATENT DOCUMENTS

CN 1436253 A 8/2003
CN 201873785 U * 6/2011

(Continued)

OTHER PUBLICATIONS

DE102013016628 Machine Translation (Year: 2015).*

(Continued)

*Primary Examiner* — Jennifer A Steele

(74) *Attorney, Agent, or Firm* — Meunier Carlin & Curfman LLC

(57) ABSTRACT

Various implementations include a melt-spun filament (or fiber), a spinneret plate for producing the melt-spun filaments, and methods of making the melt-spun filaments. The melt-spun filaments have a similar soft hand feel as natural cotton fibers and are more resilient, less absorbent, and easier to clean, according to some implementations. In addition, according to some implementations, the melt-spun filaments produce a softer and bulkier yarn than traditional trilobal shaped filaments having the same denier per filament.

18 Claims, 10 Drawing Sheets

(52) U.S. Cl.
CPC ..... *D10B 2331/02* (2013.01); *D10B 2331/04* (2013.01); *D10B 2401/041* (2013.01)

(56) References Cited

U.S. PATENT DOCUMENTS

| | | | | |
|---|---|---|---|---|
| 5,439,626 | A | 8/1995 | Bennett et al. | |
| 5,630,896 | A | 5/1997 | Corbin et al. | |
| 6,319,558 | B1 | 11/2001 | Willemsen | |
| 2002/0160188 | A1 | 10/2002 | Tam et al. | |
| 2003/0216095 | A1 | 11/2003 | Basalik | |
| 2010/0310838 | A1 | 12/2010 | Ketzer et al. | |
| 2011/0274869 | A1 | 11/2011 | Bernhard et al. | |
| 2016/0265141 | A1* | 9/2016 | Glawion | D01D 5/22 |
| 2017/0204536 | A1 | 7/2017 | Brunner et al. | |
| 2018/0179668 | A1* | 6/2018 | Topolkaraev | D02J 1/224 |
| 2024/0035204 | A1* | 2/2024 | Blakely | D06M 15/227 |

FOREIGN PATENT DOCUMENTS

| | | | | |
|---|---|---|---|---|
| CN | 202297897 | U | 7/2012 | |
| DE | 102013016628 | A1 * | 4/2015 | D01D 4/02 |
| EP | 2726674 | B1 | 4/2019 | |
| GB | 2032840 | A * | 5/1980 | B01D 69/087 |
| JP | S5024872 | A | 3/1975 | |
| JP | S56148962 | A | 11/1981 | |
| JP | H0734341 | A | 2/1995 | |
| JP | H11200188 | A | 7/1999 | |
| KR | 910007556 | B1 * | 9/1991 | D01D 5/253 |
| TW | 200526827 | A | 8/2005 | |
| WO | WO-9302234 | A1 * | 2/1993 | D01D 5/24 |

OTHER PUBLICATIONS

Machine Translation (Year: 2011).*
International Search Report and Written Opinion issued in PCT/US2021/059812, mailed Feb. 17, 2022, 10 pages.

* cited by examiner

MELT-SPUN FILAMENTS, YARNS, AND METHODS OF MAKING THE SAME

CROSS-REFERENCE TO RELATED APPLICATIONS

This application is a 35 U.S.C. § 371 national stage of International Application No. PCT/US2021/059812, filed Nov. 18, 2021, which claims the benefit of U.S. Provisional Application No. 63/116,339, filed Nov. 20, 2020, the contents of which are incorporated herein by reference in its entirety.

BACKGROUND

Cotton fiber provides a soft hand feel, but it is only available as a staple fiber, which requires it to be twisted and bound together to allow for strength in yarns. Cotton is also prone to soiling and absorbing liquids, making it difficult to use for making carpets and other textiles and making it difficult to keep clean. Thus, there is a need in the art for a melt-spun filament (or fiber) that provides the soft hand feel of cotton but is longer and has the ability to repel liquids.

BRIEF SUMMARY

According to a first aspect, a melt-spun filament has an external surface and a central axis. A cross-section of the external surface has a first perimetrical section, a second perimetrical section, a third perimetrical section, and a fourth perimetrical section. The first and third perimetrical sections are spaced apart from each other and the second and fourth perimetrical sections extend between the first and third perimetrical sections are spaced apart from each other. The first, second, and third perimetrical sections are arcuate shaped and are convex as viewed external to each respective perimetrical section, and the fourth perimetrical section is arcuate shaped and is concave as viewed external to the fourth perimetrical section. The cross-sectional shape of the external surface is viewed in a plane that extends perpendicular to the central axis of the melt-spun filament (e.g., an end view of the melt-spun filament).

In some embodiments, a radius of curvature of the first and third perimetrical sections is less than a radius of curvature of the second perimetrical section.

In some embodiments, a radius of curvature of the fourth perimetrical section is less than a radius of curvature of the second perimetrical section.

In some embodiments, a radius of curvature of the fourth perimetrical section is greater than a radius of curvature of the second perimetrical section.

In some embodiments, an arc length of the second perimetrical section is greater than an arc length of the fourth perimetrical section.

In some embodiments, the filament defines at least one axial void.

In some embodiments, the at least one void has a cross-sectional shape that corresponds to the external surface of the filament.

In some embodiments, the filament further comprises a bridge section that extends between the second and fourth perimetrical sections adjacent the central axis of the filament, wherein the bridge section and the first, second, and fourth perimetrical sections define a first void, and the bridge section and the second, third, and fourth perimetrical sections define a second void.

In some embodiments, an average radial thickness of each perimetrical section is the same.

In some embodiments, the filament comprises at least one thermoplastic material.

In some embodiments, the thermoplastic material is selected from the group consisting of one or more polyesters, one or more polyamides (PA), one or more polyolefins, or combinations thereof. In some embodiments, the one or more polyesters are selected from the group consisting of polytrimethylene terephthalate (PTT), polybutylene terephthalate (PBT), polyethylene terephthalate (PET), and combinations.

In some embodiments, the denier per filament is between 2 and 35.

According to a second aspect, a bundle of filaments comprising a plurality of the melt-spun filaments is provided.

According to a third aspect, a yarn comprising the bundle of filaments is provided.

In some embodiments, the yarn is a bulked continuous filament (BCF) yarn.

In some embodiments, the melt-spun filament according to the first aspect is converted into a plurality of staple fibers.

According to a fourth aspect, a spun yarn comprising the staple fibers is provided.

According to a fifth aspect, a carpet comprising pile made with the yarn according to the third or fourth aspects is provided.

According to a sixth aspect, apparel comprising the yarn according to the third or fourth aspects is provided.

According to a seventh aspect, a spinneret plate for producing the melt-spun filament according to the first aspect is provided. The spinneret plate comprises one or more capillaries, and each capillary defines a pair of outlet openings. Each opening has a C-shaped cross-section, and each pair of C-shaped openings are arranged relative to each other such that ends of the C-shaped openings face and are spaced apart from each other and a distance between intermediate portions of the openings is greater than a distance between the ends of the openings. The cross-sectional shape of the outlet openings is viewed in a plane that extends perpendicular to the central axis of the capillary (e.g., an end view of the capillary).

In some embodiments, an arc extends between and is spaced apart from the ends of each opening and bisects the intermediate portions of each pair of C-shaped openings.

In some embodiments, a radius of the arc ranges from 0.04 to 0.09 inches, a central angle of the arc ranges from 40 to 80 degrees, a width of the arc as measured along a chord that extends between ends of the arc ranges from 0.06 to 0.2 inches.

In some embodiments, each pair of C-shaped openings has a radial width of the opening, and the radial width ranges from 0.004 to 0.03 inches.

According to an eighth aspect, a method of making the melt-spun filament according to the first aspect is provided. The method includes (1) providing a spinneret plate comprising one or more capillaries, each capillary defining a pair of outlet openings, wherein each opening has a C-shaped cross-section, wherein each pair of C-shaped openings are arranged relative to each other such that ends of the C-shaped openings face and are spaced apart from each other, and a distance between intermediate portions of the openings is greater than a distance between the ends of the openings; and (2) feeding at least one melted thermoplastic polymer through the capillary.

In some embodiments, an arc extends between and is spaced apart from the ends of each opening and bisects the intermediate portions of each pair of C-shaped openings.

In some embodiments, a radius of the arc ranges from 0.04 to 0.09 inches, a central angle of the arc ranges from 40 to 80 degrees, a width of the arc as measured along a chord that extends between ends of the arc ranges from 0.06 to 0.2 inches.

In some embodiments, each pair of C-shaped openings has a radial width of the opening, and the radial width ranges from 0.004 to 0.03 inches.

According to a ninth aspect, a melt-spun filament has an external surface and a central axis. A cross-sectional shape of the external surface is a figure eight, and the filament defines a first void and a second void extending axially through the filament. The first void is on one side of the central axis and the second void is on the other side of the central axis.

According to a tenth aspect, a yarn comprising a plurality of the melt-spun filaments of the ninth aspect is provided.

According to an eleventh aspect, a yarn comprises at least one of a first melt-spun filament according to the ninth aspect and at least one a second melt-spun filament according to the first aspect.

BRIEF DESCRIPTION OF THE DRAWINGS

Example features and implementations are disclosed in the accompanying drawings. However, the present disclosure is not limited to the precise arrangements shown, and the drawings are not necessarily drawn to scale.

DETAILED DESCRIPTION

Figure 1:
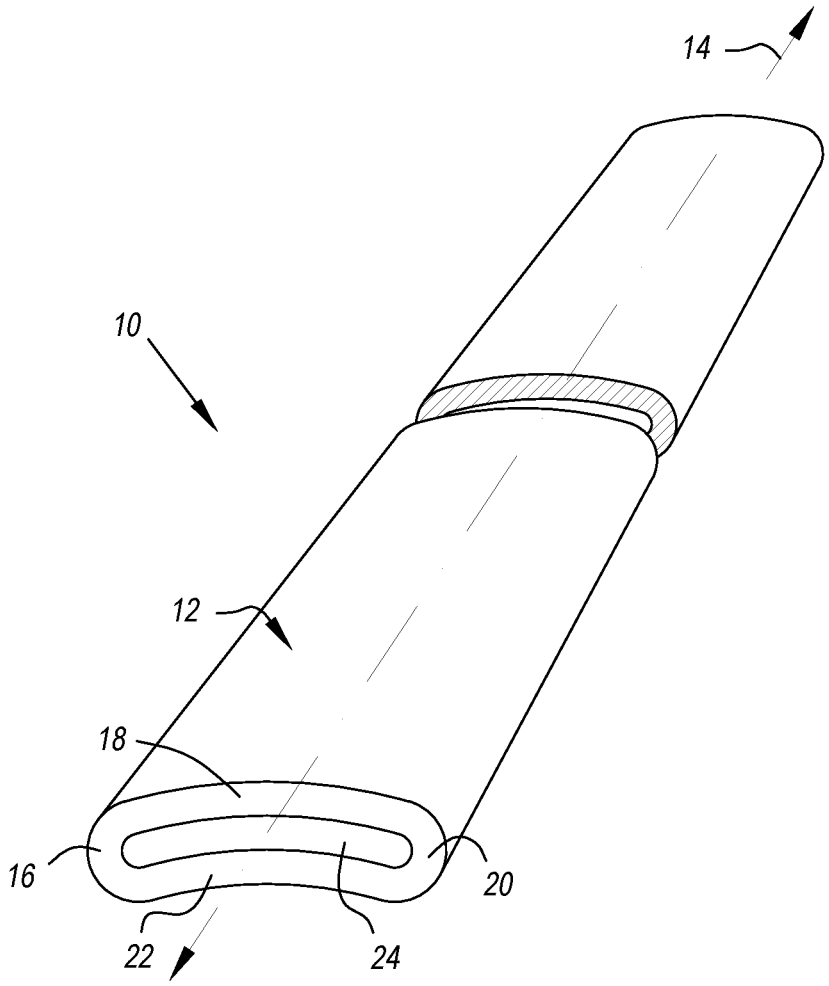
FIG. 1 illustrates a perspective end view of a melt-spun filament according to one implementation.

Various implementations include a melt-spun filament (or fiber), a spinneret plate for producing the melt-spun filaments, and methods of making the melt-spun filaments. The melt-spun filaments have a similar soft hand feel as natural cotton fibers and are more resilient, less absorbent, and easier to clean, according to some implementations. In addition, according to some implementations, the melt-spun filaments produce a softer and bulkier yarn than traditional trilobal shaped filaments having the same denier per filament. Furthermore, because these melt-spun filaments have a de-lustered appearance, no Ti—O2 additive is needed or less Ti—O2 is needed compared to a traditional trilobal shaped filament, according to some implementations. And, a topical softener may not be added to the filaments because the melt-spun filaments according to some implementations described herein are softer than a trilobal shaped filament with a topical softener at the same denier per filament.

According to a first aspect, a melt-spun filament has an external surface and a central axis. A cross-section of the external surface has a first perimetrical section, a second perimetrical section, a third perimetrical section, and a fourth perimetrical section. The first and third perimetrical sections are spaced apart from each other and the second and fourth perimetrical sections extend between the first and third perimetrical sections are spaced apart from each other. The first, second, and third perimetrical sections are arcuate shaped and are convex as viewed external to each respective perimetrical section, and the fourth perimetrical section is arcuate shaped and is concave as viewed external to the fourth perimetrical section. The cross-sectional shape of the external surface is viewed in a plane that extends perpendicular to the central axis of the melt-spun filament (e.g., an end view of the filament).

According to a second aspect, a bundle of filaments comprising a plurality of the melt-spun filaments is provided.

According to a third aspect, a yarn comprising the bundle of filaments is provided. For example, in some embodiments, the yarn is a bulked continuous filament (BCF) yarn.

In some embodiments, the melt-spun filament according to the first aspect is converted into a plurality of staple fibers.

According to a fourth aspect, a spun yarn comprising the staple fibers is provided.

According to a fifth aspect, a carpet comprising pile made with the yarn according to the third or fourth aspects is provided.

According to a sixth aspect, apparel comprising the yarn according to the third or fourth aspects is provided.

According to a seventh aspect, a spinneret plate for producing the melt-spun filament according to the first aspect is provided. The spinneret plate comprises one or more capillaries, and each capillary defines a pair of outlet openings. Each opening has a C-shaped cross-section, and each pair of C-shaped openings are arranged relative to each other such that ends of the C-shaped openings face and are spaced apart from each other and a distance between intermediate portions of the openings is greater than a distance between the ends of the openings. The cross-sectional shape of the outlet openings is viewed in a plane that extends perpendicular to the central axis of the capillary (e.g., an end view of the capillary).

According to an eighth aspect, a method of making the melt-spun filament according to the first aspect is provided. The method includes (1) providing a spinneret plate comprising one or more capillaries, each capillary defining a pair of outlet openings, wherein each opening has a C-shaped cross-section, wherein each pair of C-shaped openings are arranged relative to each other such that ends of the C-shaped openings face and are spaced apart from each other, and a distance between intermediate portions of the openings is greater than a distance between the ends of the openings; and (2) feeding at least one melted thermoplastic polymer through the capillary. The cross-sectional shape of the outlet openings is viewed in a plane that extends perpendicular to the central axis of the capillary (e.g., an end view of the capillary). In some embodiments, an arc extends between and is spaced apart from the ends of each opening and bisects the intermediate portions of each pair of C-shaped openings.

According to a ninth aspect, a melt-spun filament has an external surface and a central axis. A cross-sectional shape of the external surface is a figure eight, and the filament defines a first void and a second void extending axially through the filament. The first void is on one side of the central axis and the second void is on the other side of the central axis. The cross-sectional shape of the external surface is viewed in a plane that extends perpendicular to the central axis of the melt-spun filament (e.g., an end view of the melt-spun filament).

According to a tenth aspect, a yarn comprising a plurality of the melt-spun filaments of the ninth aspect is provided.

According to an eleventh aspect, a yarn comprises at least one of a first melt-spun filament according to the ninth aspect and at least one a second melt-spun filament according to the first aspect.

For example, FIG. 1 illustrates an example melt-spun filament 10 according to one implementation. The melt-spun filament 10 has an external surface 12 and a central axis 14. A cross-section of the external surface 12 has a first perimetrical section 16, a second perimetrical section 18, a third perimetrical section 20, and a fourth perimetrical section 22. The first 16 and third perimetrical sections 20 are spaced apart from each other and the second 18 and fourth perimetrical sections 22 extend between the first 16 and third perimetrical sections 20 are spaced apart from each other. The first 16, second 18, and third 20 perimetrical sections are arcuate shaped and are convex as viewed external to each respective perimetrical section, and the fourth perimetrical section 22 is arcuate shaped and is concave as viewed external to the fourth perimetrical section 22. The cross-sectional shape of the external surface 12 is viewed in a plane that extends perpendicular to the central axis 14.

A radius of curvature of the first 16 and third perimetrical sections 20 is less than a radius of curvature of the second perimetrical section 18. And, a radius of curvature of the fourth perimetrical section 22 is less than a radius of curvature of the second perimetrical section 18. The relative radii of curvature of the second perimetrical section and the fourth perimetrical section can depend on the shape of the opening in the spinneret, the type of polymer, the temperature of the polymer being spun through the opening of the spinneret (e.g., relative to the polymer's melting temperature), and/or the processing speed of the spinning process. In addition, an arc length of the second perimetrical section 18 is greater than an arc length of the fourth perimetrical section 22.

The melt-spun filament 10 defines an axial void 24. The void 24 has a cross-sectional shape that corresponds to the external surface 12 of the melt-spun filament. However, in other implementations, the void may have a cross-sectional shape that is different from the shape of the external surface 12. The cross-sectional shape of the void is the shape of the void as viewed in a plane that extends perpendicular to the central axis of the melt-spun filament (e.g., an end view of the melt-spun filament). The cross-sectional shape of the void depends, at least in part, on how the melt-spun filament portions exiting the spinneret's outlet openings coalesce together to form the filament. This coalescence may depend on the type of polymer, the temperature of the polymer during spinning (e.g., relative to the polymer's melting temperature), how the heat transfers from the spun filaments to the cool air of the quench, and/or the processing speed of the spinning process.

An average radial thickness of each perimetrical section 16, 18, 20, 22 is the same. The radial thickness of each perimetrical section 16, 18, 20, 22 is measured in a radial direction relative to the central axis 12.

The melt-spun filament 10 includes at least one thermoplastic material. For example, the thermoplastic material may be selected from the group consisting of one or more polyesters, one or more polyamides (PA), one or more polyolefins, or combinations thereof. Example polyesters include polytrimethylene terephthalate (PTT), polybutylene terephthalate (PBT), and polyethylene terephthalate (PET). Example polyamides include nylon 6 and nylon 6,6. Example polyolefins include polypropylene (PP) and polyethylene (PE). The melt-spun filament is a single component filament, but in other implementations, the melt-spun filament can be a multi-component filament. In some embodiments, the first or second material may include a polyolefin and a carbon filler to produce an antistatic yarn. The thermoplastic material resin may be virgin or reclaim grade, according to some embodiments.

The titer per fiber or filament (also referred to as "denier per filament," "denier per fiber," or "dpf") range is between 2 and 35 dpf (e.g., 9 dpf).

The melt-spun filament 10 may twist about its axis 12. The twisting is due to the arc length of the second perimetrical section being different from the fourth perimetrical section. The level of twisting is a result of one or more factors, such as the type of polymer, its viscosity, the temperature of the polymer during spinning (e.g., relative to the polymer's melting temperature), the quench setup, and the extruder set-up.

Figure 2A:
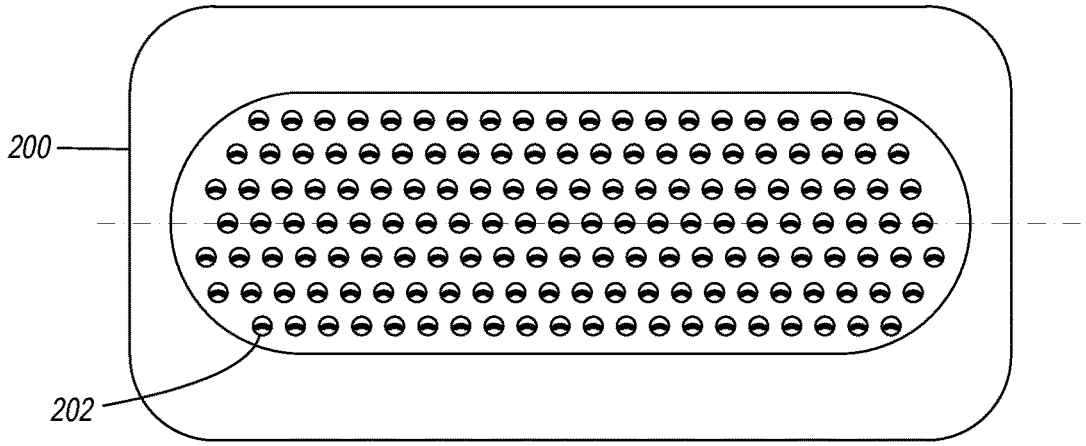
FIG. 2A illustrates a plan view of a portion of a spinneret plate defining a plurality of capillaries according to one implementation.
Figure 2B:
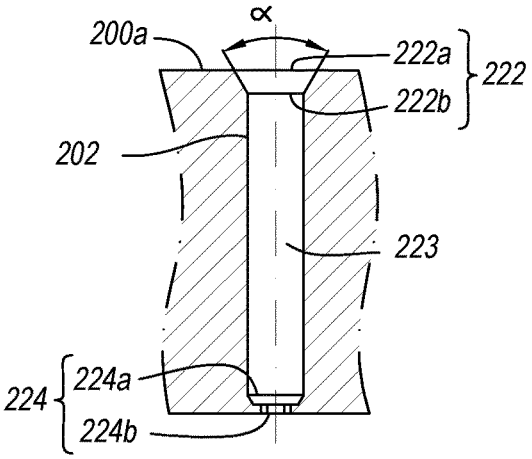
FIG. 2B illustrates a cross-sectional view of one of the capillaries in FIG. 2A as viewed in a plane that includes the central axis of the capillary. And, FIG. 2C illustrates an end view of the capillary in FIG. 2B.
Figure 2C:
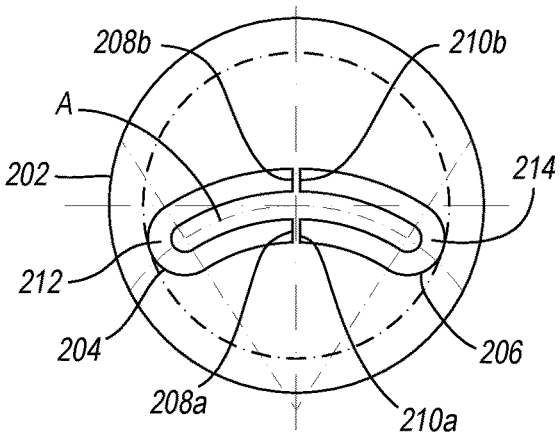
Figure 3:
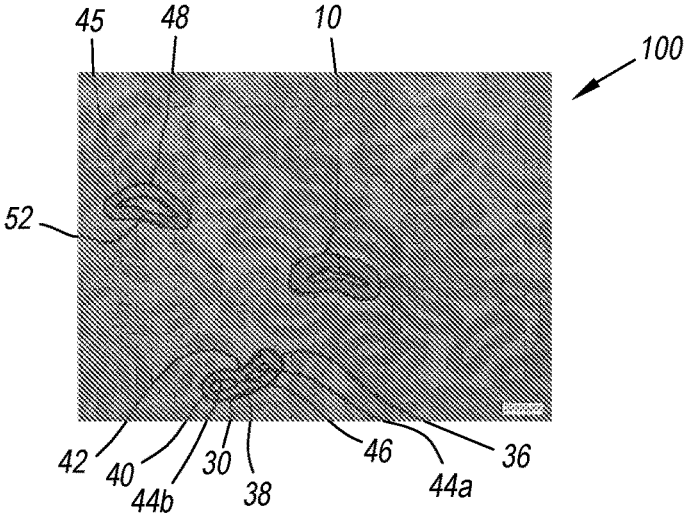
FIG. 3 is a photograph of an end view of a plurality of melt-spun filaments, such as the melt-spun filament shown in FIG. 1, spun through the spinneret plate in FIG. 2A.

FIG. 3 is a photograph of end views of a plurality of melt-spun filaments spun from spinneret plate 200 shown in FIGS. 2A-2C and described below. As shown, the plurality of melt-spun filaments includes one or more melt-spun filaments 10 and one or more melt-spun filaments having end shapes that differ slightly from the end shape of the melt-spun filament 10, such as melt-spun filaments 30 and 45. The variation in shapes can be due to the type of polymer and/or the temperature of the polymer as the polymer is spun.

For example, melt-spun filament 30 is similar to melt-spun filament 10 but include two voids. The melt-spun filament 30 includes a bridge section 46 that extends between the second 38 and fourth perimetrical sections 42 adjacent the central axis of the melt-spun filament 30. The bridge section 46 and the first 36, second 38, and fourth perimetrical sections 42 define a first void 44*a*, and the bridge section 46 and the second 38, third 40, and fourth perimetrical sections 42 define a second void 44*b*. The external surface of the melt-spun filament 30 has a figure eight shape as viewed in a plane that extends perpendicular to the central axis, wherein the first void 44*a* is on one side of the central axis of the filament 30 and the second void 44*b* is on the other side of the central axis. In other implementations, not shown, the melt-spun filament may have no voids or two or more voids.

Melt-spun filament 45 is similar to melt-spun filament 10 but the radius of curvature of the fourth perimetrical section 52 is greater than a radius of curvature than the second perimetrical section 48.

As shown in FIG. 3, a plurality of the melt-spun filaments, such as one or more of the melt-spun filaments 10, 30, and 45, may be combined together into a bundle of filaments 100, and the bundle of filaments 100 may be combined into a yarn. For example, the yarn may be a bulked continuous filament (BCF) yarn. Alternatively, the melt-spun filaments may be converted into a plurality of staple fibers, and the staple fibers may be combined into a spun yarn.

Any of the yarns described above may be used as pile yarn in a carpet or in apparel.

FIGS. 2A-2C illustrate spinneret plate 200 for spinning melted thermoplastic material into a filament, such as filaments 10, 30, and 45, according to one implementation. The spinneret plate 200 defines one or more capillaries 202, and each capillary 202 defines a pair of outlet openings 204, 206. Each opening 204, 206 has a C-shaped cross-section, and each pair of C-shaped openings 204, 206 are arranged relative to each other such that ends 208*a*, 208*b*, 210*a*, 210*b* of the C-shaped openings 204, 206 face and are spaced apart from each other and a distance between intermediate portions 212, 214 of the openings 204, 206 is greater than a distance between the ends 208*a-b*, 210*a-b* of the openings 204, 206.

As shown in FIG. 2B, each capillary 202 has a first end portion 222, a second end portion 224, and an intermediate portion 223 therebetween. The intermediate portion has a constant cross-sectional area along the length of the capillary 202. Each end portion is tapered. The surface of each end portion 222, 224 slants an angle α of between 45° and 80°. For example, the angle α shown in FIG. 2B is 45°. The first end portion 222 has a cross-sectional area that decreases axially from a first end 222*a* of the first end portion 222 to a second end 222*b* of the first end portion 222, wherein the first end 222*a* is defined by a first surface 200*a* of the spinneret plate 200. The second end portion 224 has a cross-sectional area that decreases axially from a first end 224*a* of the second end portion 224 to a second end 224*b* of the second end portion 224, wherein the second end 224*b* is defined by a second surface of the spinneret plate 100.

As shown in FIG. 2C, an arc A extends between and is spaced apart from the ends 208*a-b*, 210*a-b* of each opening 204, 206 and bisects the intermediate portions 212, 214 of each pair of C-shaped openings 204, 206. A radius of curvature of the arc A ranges from 0.04 to 0.09 inches, a central angle of the arc ranges from 40 to 80 degrees, and a width of the arc as measured along a chord that extends between ends of the arc ranges from 0.06 to 0.2 inches. Each pair of C-shaped openings 204, 206 has a radial width ranging from 0.004 to 0.03 inches. These dimensions are examples of suitable dimensions for spinning PET to form melt-spun filaments, such as those described herein, but other dimensions and/or outlet opening shapes may be selected depending on the properties of the polymer (e.g., its flow properties).

Figure 12:
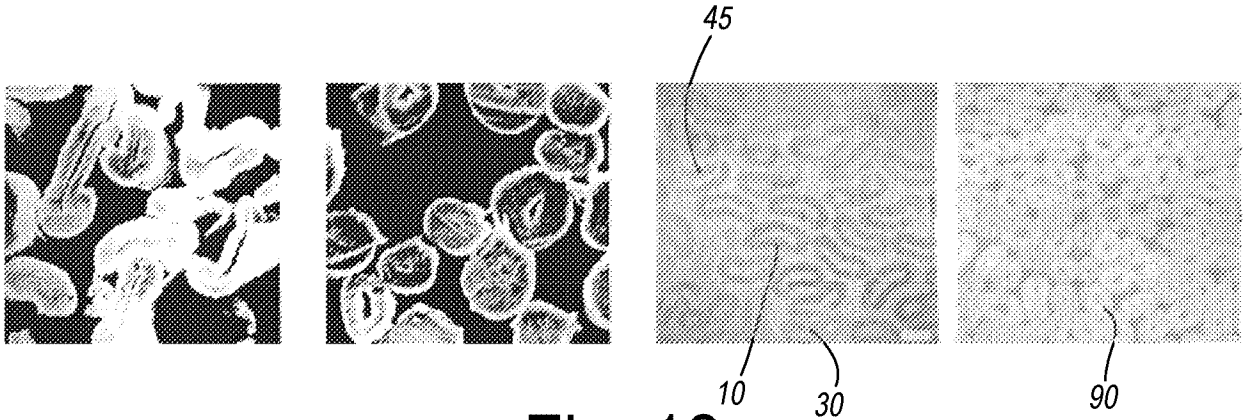
FIG. 12 shows photographs of end views of natural untreated cotton staple fibers, natural mercerized cotton staple fibers, the melt-spun filaments shown in FIG. 3, and melt-spun filaments spun through the spinneret plate in FIG. 2A at a different denier per yarn and filament per yarn count than the plurality of filaments shown in FIG. 3.
Figure 13:
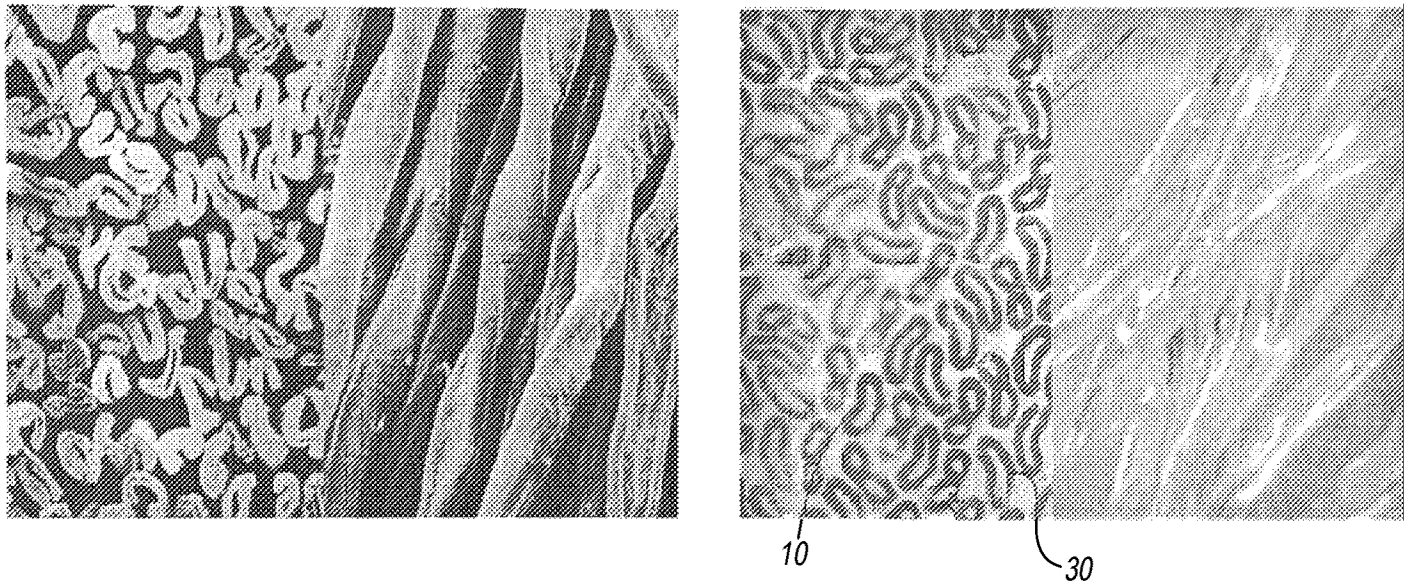
FIG. 13 shows photographs of end views and axial views of natural cotton fibers and the melt-spun filaments shown in FIG. 3.

The polymer of the melt-spun filaments 10, 30, 45 shown in FIG. 3 is PET, and the PET is spun through the spinneret 200 at 1350 denier per yarn and 150 filaments per yarn, resulting in filaments with 9 DPF, for example. In other implementations, the yarn may be made from one or more spinnerets. In addition, the spinneret 200 may produce a plurality of melt-spun filaments having a different shape if the denier per yarn and/or filaments per yarn are changed. For example, the right-most photograph in FIG. 12 illustrates melt-spun filaments 90 each having an external surface that is oval shaped as viewed in the plane that is perpendicular to the central axis of the melt-spun filament. Each filament also defines an axial void. The polymer of the melt-spun filaments 90 shown in FIG. 12 is PET, and the PET is spun through the spinneret 200 at 1100 denier per yarn and 300 filaments per yarn, resulting in filaments with 3.6 DPF. And, as shown in FIG. 12, the melt-spun filaments 10, 30, 45 have a similar hand feel as untreated cotton fibers. In addition, the melt-spun filaments 90 have a similar hand feel as mercerized cotton, which is silkier/softer than untreated cotton. FIG. 13 is a photograph of end views and axial views of natural, untreated cotton fibers and the melt-spun filaments shown in FIG. 3.

Figure 4A:
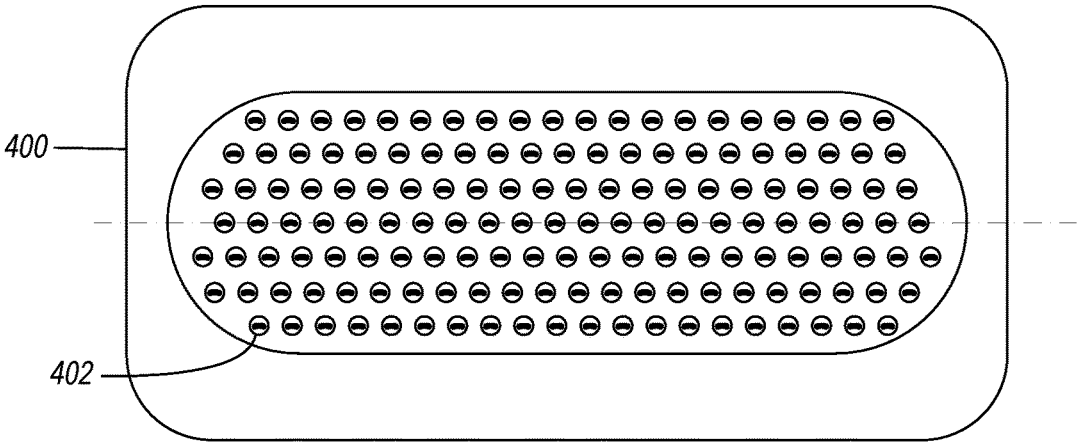
FIG. 4A illustrates a plan view of a portion of a spinneret plate defining a plurality of capillaries according to another implementation.
Figure 4B:
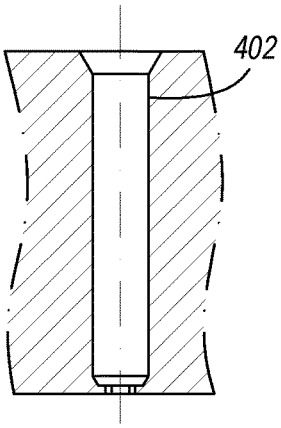
FIG. 4B illustrates a cross-sectional view of one of the capillaries in FIG. 4A as viewed in a plane that includes the central axis of the capillary. And, FIG. 4C illustrates an end view of the capillary in FIG. 4B.
Figure 4C:
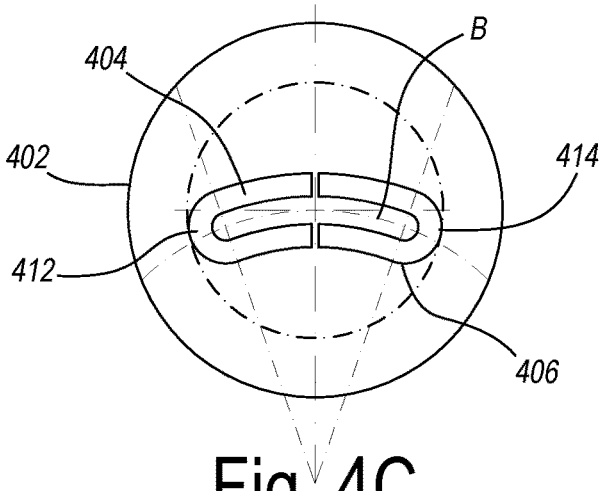
Figure 5:
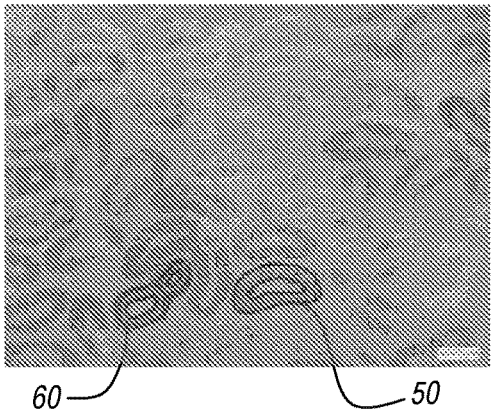
FIG. 5 is a photograph of an end view of a plurality of melt-spun filaments, such as the melt-spun filaments spun through the spinneret plate in FIG. 4A.

FIGS. 4A-4C illustrates a spinneret plate 400 for spinning melted thermoplastic material into a filament, according to another implementation. The spinneret plate 400 is similar to spinneret plate 200. Like spinneret plate 200, spinneret plate 400 defines one or more capillaries 402, and each capillary 402 defines a pair of outlet openings 404, 406. However, the radius of curvature of the arc B extending through intermediate portions 412, 414 of the openings 404, 406 is greater than the radius of curvature of the arc A shown in FIG. 2C. In addition, the central angle of the arc B is less than the central angle of the arc A, the width of the arc B is less than the width of the arc A, and the radial width of the openings 404, 406 is the same as the radial width of the openings 204, 206. FIG. 5 illustrates a plurality of melt-spun filaments 50, 60 that are produced through the spinneret 400. The melt-spun filaments 50, 60 are similar to the filaments 30, respectively.

Figure 6A:
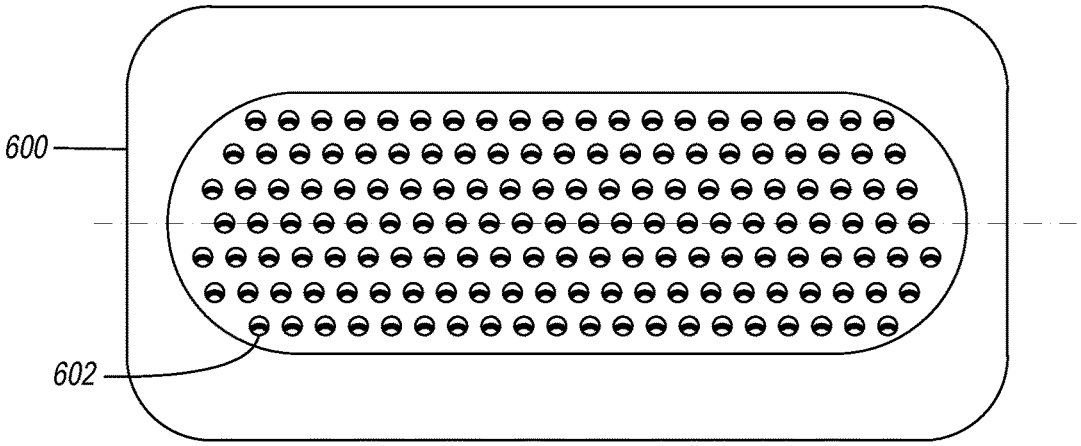
FIG. 6A illustrates a plan view of a portion of a spinneret plate defining a plurality of capillaries according to another implementation.
Figure 6B:
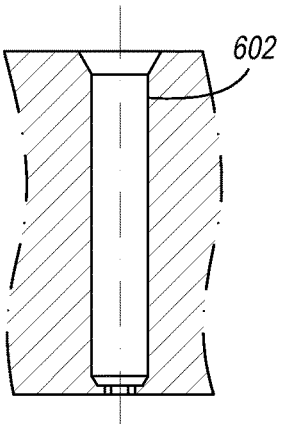
FIG. 6B illustrates a cross-sectional view of one of the capillaries in FIG. 6A as viewed in a plane that includes the central axis of the capillary. And, FIG. 6C illustrates an end view of the capillary in FIG. 6B.
Figure 6C:
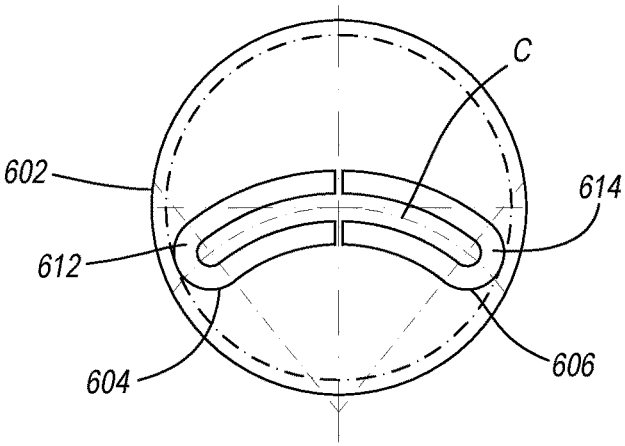
Figure 7:
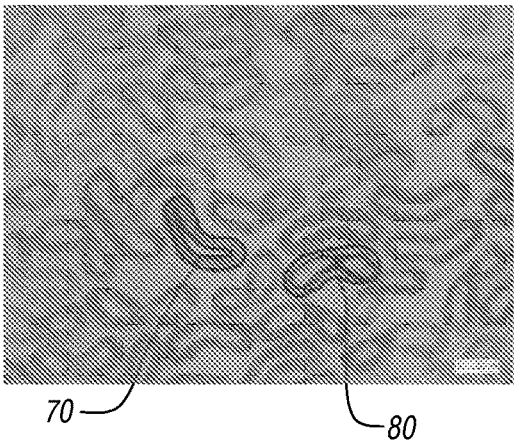
FIG. 7 is a photograph of an end view of a plurality of melt-spun filaments, such as the melt-spun filaments spun through the spinneret plate in FIG. 6A.

FIGS. 6A-6C illustrates a spinneret plate 600 according to another implementation. The spinneret plate 600 is similar to spinneret plate 200. Like spinneret plate 200, spinneret plate 600 defines one or more capillaries 602, and each capillary 602 defines a pair of outlet openings 604, 606. However, the radius of curvature of the arc C of extending through intermediate portions 612, 614 of the openings 604, 606 is less than the radius of curvature of the arc A shown in FIG. 2C. In addition, the central angle of the arc C is the same as central angle of the arc A, the width of the arc C is greater than the width of the arc A, and the radial width of the openings 604, 606 is less than the radial width of the openings 204, 206. FIG. 7 illustrates a plurality of melt-spun filaments 70, 80 that are produced through the spinneret 600. The melt-spun filaments 70, 80 are similar to the filaments 10, 30, respectively.

Figure 8:
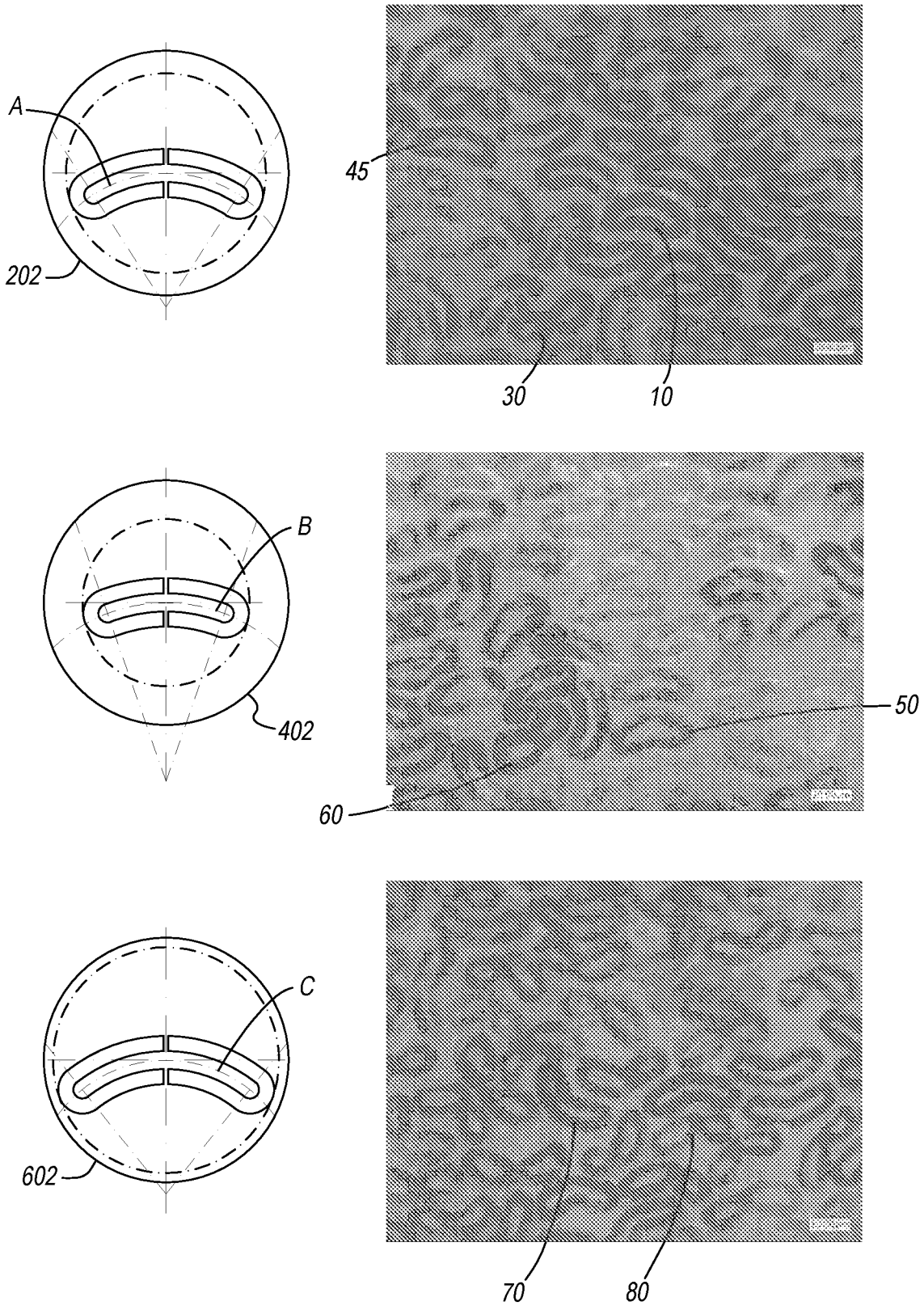
FIG. 8 illustrates end views of capillaries shown in FIGS. 2C, 4C, and 6C and photographs of end views of the melt-spun filaments shown in FIGS. 3, 5, and 7.

FIG. 8 provides a comparison of the end views of capillaries shown in FIGS. 2C, 4C, and 6C and photographs of end views of the melt-spun filaments shown in FIGS. 3, 5, and 7.

Figure 9:
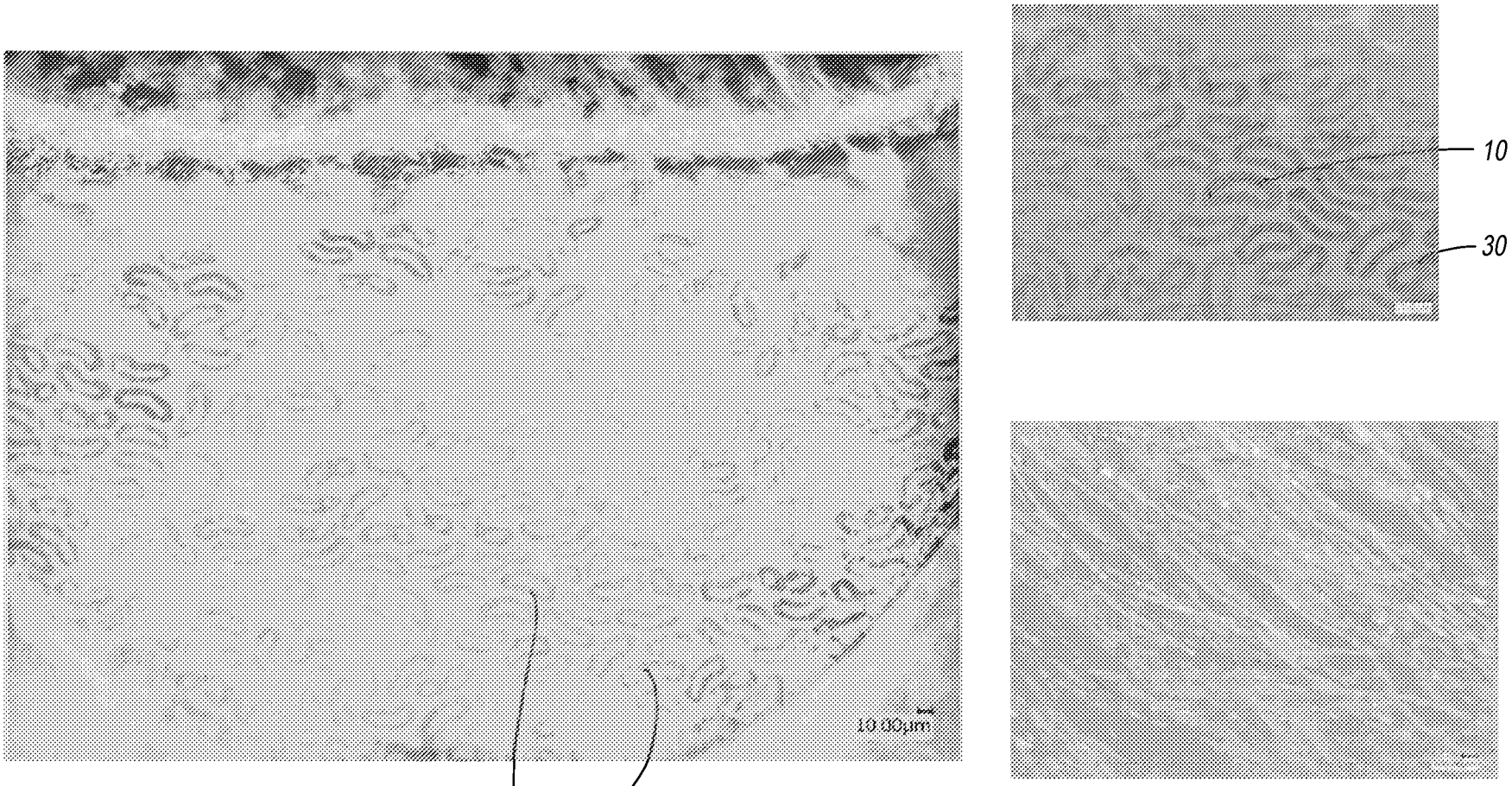
FIGS. 9-11 illustrates various photographs of melt-spun filaments spun from the spinnerets in FIGS. 2A-2C, 4A-4C, and 6A-6C, respectively.
Figure 10:
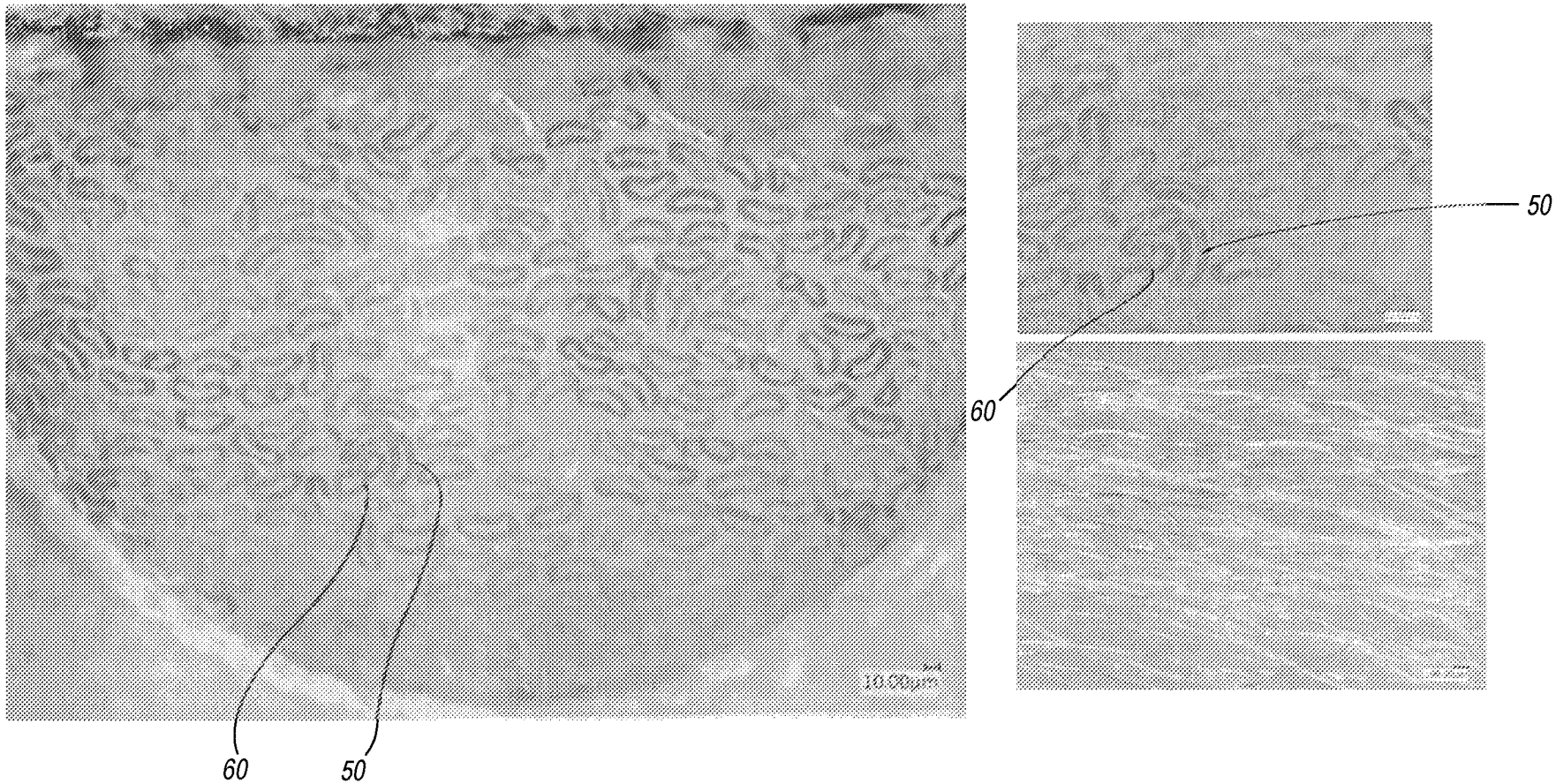
Figure 11:
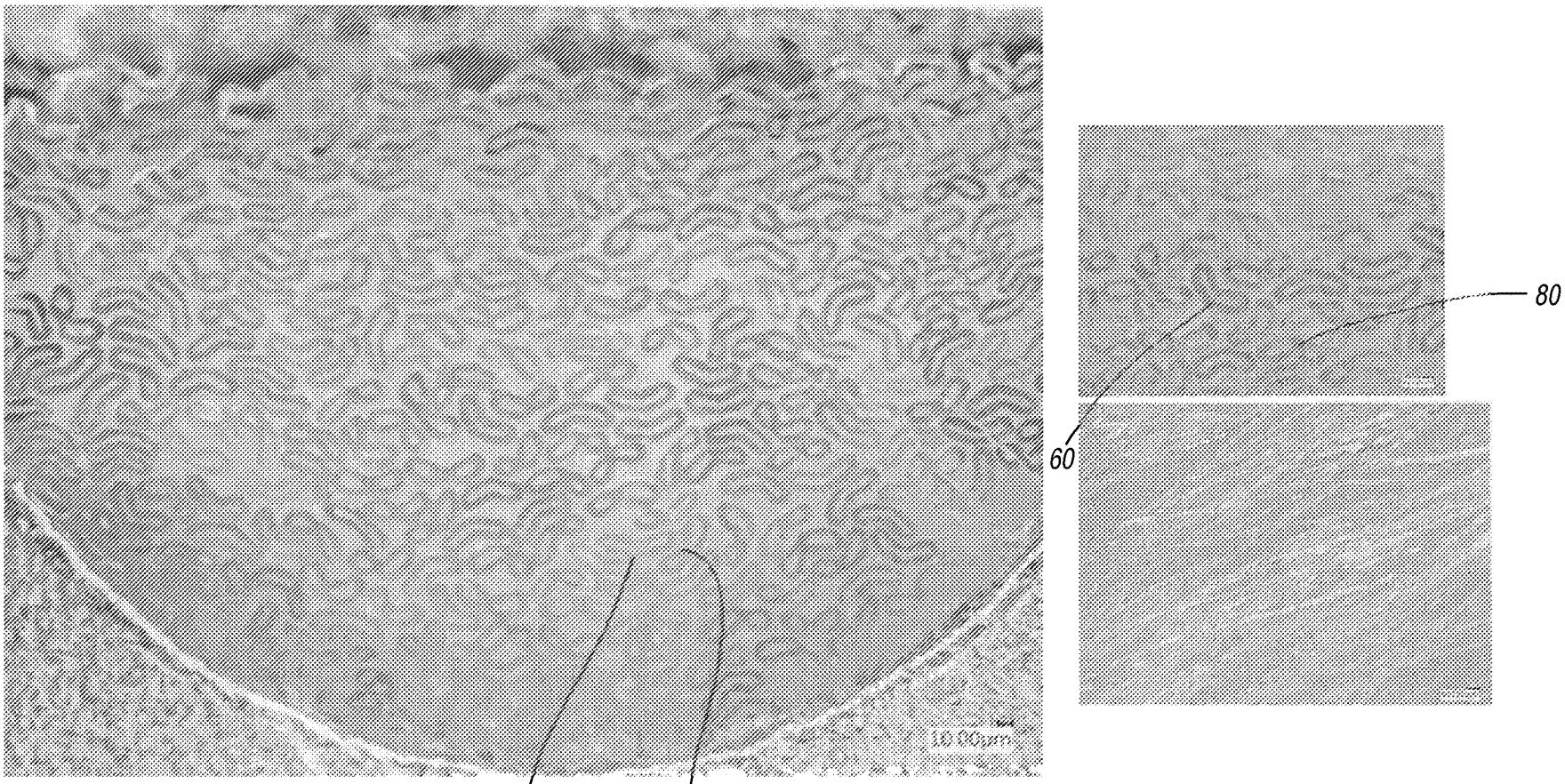

FIGS. 9-11 illustrates various photographs of melt-spun filaments spun from the spinnerets in FIGS. 2A-2C, 4A-4C, and 6A-6C, respectively. In each of FIGS. 9-11, there are views showing the ends of the filaments and an axial view of the filaments, showing the twisting about the central axis of each filament.

Figure 14:
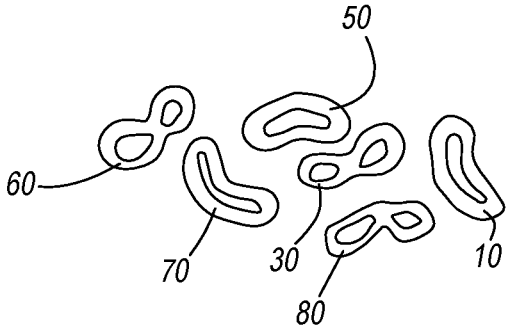
FIG. 14 illustrates end views of a variety of melt-spun filaments spun from the spinnerets in FIGS. 2A-2C, 4A-4C, and 6A-6C.

FIG. 14 illustrates end views of a variety of melt-spun filaments 10, 30 that are produced through the spinneret 200, a variety of melt-spun filaments 50, 60 that are produced through the spinneret 400, and a variety of melt-spun filaments 70, 80 that are produced through the spinneret 600.

In other implementations, the melt-spun filament, such as melt-spun filaments 10, 30, 45, 60, 70, 80 are converted into a plurality of staple fibers. Staple fibers have shorter lengths, such as 2 to 3 inches long, compared to filaments, which have long continuous lengths. For example, the melt-spun filament may be converted to a plurality of staple fibers by stretch breaking or chopping one or more of such melt-spun filaments. And, in some implementations, a plurality of the staple fibers may be bundled.

According to some implementations, the melt-spun filaments described above are made by (1) providing a spinneret plate comprising one or more capillaries, each capillary defining a pair of outlet openings, wherein each opening has a C-shaped cross-section, wherein each pair of C-shaped openings are arranged relative to each other such that ends of the C-shaped openings face and are spaced apart from each other, and a distance between intermediate portions of the openings is greater than a distance between the ends of the openings; and (2) feeding at least one melted thermoplastic polymer through the capillary. For example, the spinneret plate may be one of the spinneret plates 200, 400, 600 described above.

Various factors contribute to the shape and denier per filament of the filaments, including the type of polymer, its melting temperature, the temperature of the polymer during spinning, the speed of the pump in communication with the extruder, the draw ratio, and the rate at which the filaments are cooled. Altering one or more of these factors can provide the desired shape. For example, if the pump speed is increased but all other factors remain the same, the denier per filament is increased. If the draw ratio is increased and all other factors remain the same, the denier per filament is decreased. As another example, if the cooling rate is increased and all other factors remain the same, the cross-sectional shape of the filament is more defined. In addition, the shape and/or dimensions of the capillaries and/or the outlet openings of the capillaries of the spinneret plates may be altered from those described above depending on properties of the polymer being spun. For example, a lower viscosity PET may be spun through capillaries with different dimensions than a higher viscosity PET.

Various implementations have been described. Nevertheless, it will be understood that various modifications may be made without departing from the spirit and scope of the description. Accordingly, other implementations are within the scope of the following claims.

Disclosed are materials, systems, devices, methods, compositions, and components that can be used for, can be used in conjunction with, can be used in preparation for, or are products of the disclosed methods, systems, and devices. These and other components are disclosed herein, and it is understood that when combinations, subsets, interactions, groups, etc. of these components are disclosed that while specific reference of each various individual and collective combinations and permutations of these components may not be explicitly disclosed, each is specifically contemplated and described herein. For example, if a device is disclosed and discussed every combination and permutation of the device, and the modifications that are possible are specifically contemplated unless specifically indicated to the contrary. Likewise, any subset or combination of these is also specifically contemplated and disclosed. This concept applies to all aspects of this disclosure including, but not limited to, steps in methods using the disclosed systems or devices. Thus, if there are a variety of additional steps that can be performed, it is understood that each of these additional steps can be performed with any specific method steps or combination of method steps of the disclosed methods, and that each such combination or subset of combinations is specifically contemplated and should be considered disclosed.

The invention claimed is:

1. A method of making a melt-spun filament, comprising:

providing a spinneret plate comprising one or more capillaries, each capillary defining a pair of outlet openings, wherein:

each opening has a C-shaped cross-section comprising a first and second end, an intermediate portion, and limbs linking the ends to the intermediate portion, each pair of C-shaped openings are arranged relative to each other such that ends of the C-shaped openings face and are spaced apart from each other, a distance between intermediate portions of the C-shaped openings is greater than a distance between the ends of the openings, and the ends of each opening are equidistant from a midpoint line of an arc between the intermediate portions of the C-shaped openings, wherein the midpoint line is defined by a line from a center of curvature of the arc through a bisector of the arc, the arc extends between and is spaced apart from the ends of each opening and bisects the intermediate portions of each pair of C-shaped openings, the limbs of each C-shaped opening are spaced apart and adjacent the arc between the ends and the intermediate portion, and each C-shaped opening is chiral and is reflectionally symmetrically identical to the other C-shaped opening around the midpoint line;

feeding at least one melted thermoplastic polymer through the capillary; and wherein the melt-spun filament comprises:

an external surface and a central axis, wherein a cross-section of the external surface has a first perimetrical section, a second perimetrical section, a third perimetrical section, and a fourth perimetrical section;

wherein the first and third perimetrical sections are spaced apart from each other and the second and fourth perimetrical sections extend between the first and third perimetrical sections and are spaced apart from each other;

wherein the first, second, and third perimetrical sections are arcuate shaped and are convex as viewed external to each respective perimetrical section; and the fourth perimetrical section is arcuate shaped and is concave as viewed external to the fourth perimetrical section.

2. The method of claim 1, wherein a radius of curvature of the first and third perimetrical sections of the melt-spun filament is less than a radius of curvature of the second perimetrical section.

3. The method of claim 2, wherein a radius of curvature of the fourth perimetrical section of the melt-spun filament is less than a radius of curvature of the second perimetrical section.

4. The method of claim 2, wherein a radius of curvature of the fourth perimetrical section of the melt-spun filament is greater than a radius of curvature of the second perimetrical section.

5. The method of claim 4, wherein an arc length of the second perimetrical section is greater than an arc length of the fourth perimetrical section.

6. The method of claim 5, wherein the melt-spun filament defines at least one axial void.

7. The method of claim 6, wherein the first void of the melt-spun filament has a cross-sectional shape that corresponds to the external surface of the filament.

8. The method of claim 6, wherein the melt-spun filament further comprises a bridge section that extends between the second and fourth perimetrical sections adjacent the central axis of the filament, wherein the bridge section and the first, second, and fourth perimetrical sections define a first void, and the bridge section and the second, third, and fourth perimetrical sections define a second void.

9. The method of claim 8, wherein the denier per filament of the melt-spun filament is between 2 and 35.

10. The method of claim 9, wherein the melt-spun filament comprises at least one thermoplastic material.

11. The method to claim 10, wherein the thermoplastic material is selected from the group consisting of one or more polyesters, one or more polyamides (PA), one or more polyolefins, and combinations thereof.

12. The method of claim 1, wherein a radius from the center of curvature of the arc to the arc ranges from 0.04 to 0.09 inches, a central angle of the arc ranges from 40 to 80 degrees, and a width of the arc as measured along a chord that extends between ends of the arc ranges from 0.06 to 0.2 inches.

13. The method of claim 12, wherein each pair of C-shaped openings has a radial width of its respective opening, and the radial width ranges from 0.004 to 0.03 inches.

14. The method of claim 1, wherein the center of curvature of the arc is distal from a center of its respective capillary.

15. The method of claim 14, wherein a radius from the center of curvature of the arc to the arc ranges from 0.04 to 0.09 inches, a central angle of the arc ranges from 40 to 80 degrees, and a width of the arc as measured along a chord that extends between ends of the arc ranges from 0.06 to 0.2 inches.

16. A spinneret plate for producing a melt-spun filament, comprising:

a plurality of capillaries, wherein each capillary is fluidly connected to a first outlet opening and to a second outlet opening on an extrusion face of the spinneret plate, wherein:

each of the first and second outlet openings of the plurality of capillaries have a C-shaped cross-section on the extrusion face such that the first outlet opening C-shaped cross-section is symmetrical to and chiral to the second outlet opening C-shaped cross-section, the first opening C-shaped cross-section is arranged relative to the second opening C-shaped cross-section such that ends of the first opening C-shaped cross-section face and are spaced apart from ends of the ends of the second opening C-shaped cross-section, the ends of the first opening C-shaped cross-section are spaced equidistant from a midpoint of an arc between the intermediate portions of the first and second C-shaped openings, the ends of the second opening C-shaped cross-section are spaced equidistant from a midpoint of the arc between the intermediate portions of the first and second C-shaped openings, and the ends of the first opening C-shaped cross-section are equidistant from the ends of the second opening C-shaped cross-section along a line bisecting the arc.

17. The spinneret plate of claim 16, wherein a radius of the arc ranges from 0.04 to 0.09 inches, a central angle of the arc ranges from 40 to 80 degrees, and a width of the arc as measured along a chord that extends between endpoints of the arc ranges from 0.06 to 0.2 inches.

18. The spinneret plate of claim 17, wherein each of the first opening C-shaped cross-section and the second opening C-shaped cross-section have a radial width of their opening, and the radial width ranges from 0.004 to 0.03 inches.

* * * * *